United States Patent [19]

Walton

[11] Patent Number: 4,628,550

[45] Date of Patent: Dec. 16, 1986

[54] SWING-IN-SWING-OUT SHOWER CHAIR

[76] Inventor: Claude G. Walton, 401 W. 24th St., Apt. 67, Fayetteville, Ark. 72701

[21] Appl. No.: 667,998

[22] Filed: Nov. 5, 1984

[51] Int. Cl.[4] ..... A47K 3/12; A47K 3/00

[52] U.S. Cl. ..... 4/560; 4/561; 4/562; 4/559

[58] Field of Search ..... 4/562, 496, 251, 563, 4/561, 560, 559, 564, 565, 566

[56] References Cited

U.S. PATENT DOCUMENTS

| | | | |
|---|---|---|---|
| 3,289,217 | 12/1966 | Glover | 4/562 |
| 3,381,317 | 5/1968 | Daniels et al. | 4/563 |
| 3,815,163 | 6/1974 | Sullivan | 4/562 |
| 3,918,108 | 11/1975 | Feyerherm | 4/251 |
| 3,994,030 | 11/1976 | Cassell et al. | 4/563 |
| 4,221,008 | 9/1980 | Nolan | 4/496 |

*Primary Examiner*—Henry K. Artis

*Attorney, Agent, or Firm*—Head, Johnson & Stevenson

[57] ABSTRACT

A swing-in-swing-out chair apparatus for a bathtub-showerstall unit, or the like, and comprising a bar adapted to be disposed on the floor adjacent the outer periphery of the bathtub, an upright post extending from the bar to a position above the upper edge of the bathtub and pivotal about its own longitudinal axis, a seat support arm assembly secured to the upright post and movable therewith, a seat member secured to the support arm assembly and movable between an exterior position with respect to the bathtub-shower stall unit and an interior position with respect to the bathtub-shower stall unit and an interior position with respect thereto, and an anchoring apparatus carried by the upright post for securely and removably anchoring the swing-in-swing-out chair apparatus to the sidewall of the bathtub-shower stall unit, the apparatus being particularly designed for transfer of the weight of the occupant of the seat to the floor at all times for assuring stability for the occupant and apparatus.

9 Claims, 8 Drawing Figures

SWING-IN-SWING-OUT SHOWER CHAIR

BACKGROUND OF THE INVENTION

1. Field of the Invention

This invention relates to improvements in seat attachment apparatus for bathtubs and/or shower stalls and more particularly to a swing-in-swing-out seat attachment for facilitating the use of the shower.

2. Description of the Prior Art

Many accidents occur in the use of bathtubs and showers, and particularly when these installations are utilized by persons who are elderly or somewhat incapacitated. Standing within a shower stall or in a bathtub while taking a shower can be a problem for many persons. In order to overcome these problems, many devices have been developed for supporting a person in a sitting position while bathing or showering. Such apparatus is shown in the Arburg Pat. No. 1,076,808, issued Oct. 28, 1913, and entitled "Bath Room Fixture;" Higgins Pat. No. 2,052,628, issued Sept. 1, 1936, and entitled "Bathtub Seat;" Scheuerman et al Pat. No. 2,664,142, issued Dec. 29, 1953, and entitled "Bathtub Chair;" Turner Pat. No. 3,071,779 issued Jan. 8, 1963, and entitled "Power Operated Bathtub Seat;" and Murcott Pat. No. 3,203,008, issued Aug. 31, 1965, and entitled "Swingable Seat Structure for Bathtubs." These devices have certain disadvantages, however, in that they are somewhat cumbersome to use and expensive in construction.

SUMMARY OF THE INVENTION

The present invention contemplates a novel swing-in-swing-out chair adapted to be installed on the side of a bathtub, or the like, for facilitating the showering by a person who might otherwise be uneasy or intimidated by the bathtub or shower stall appliance. The novel seat apparatus is adapted for either a right-hand or left-hand installation and comprises an upright post supported by a horizontally disposed bar adapted to be disposed on the floor and against the lower edge of the bathtub, or the like. A radially outwardly extending arm means supporting a seat member is pivotally secured to the upright post and is readily movable between an "out" position and an "in" position with respect to the bathtub or shower stall whereby the user of the apparatus may initially rest or position himself on the seat in the "out" position thereof and physically pivot the seat and arm means about the axis of the upright post for moving the seat to the "in" position thereof with respect to the bathtub or shower stall. In this manner, the user of the apparatus may remain in a sitting position while showering, thus achieving self-confidence and increasing the personal safety of a showering operation. When the showering has been completed, the seat and arm means may be pivoted in an opposite direction about the axis of the upright post for moving the seat to the "out" position therefor, whereupon the user of the apparatus may leave the seat at a location exterior of the bathtub or shower stall. The weight of the user of the apparatus is constantly transferred to the floor, thus providing stability for the apparatus. In addition, adjustment means is provided for the upright post in order to compensate for the contour of the outer periphery of the bathtub, or the like, wherein the apparatus is installed, thus assuring an efficient upright position of the post. The novel swing-in-swing-out seat apparatus is simple and efficient in operation and economical and durable in construction.

DETAILED DESCRIPTION OF THE PREFERRED EMBODIMENT

Figure 5:
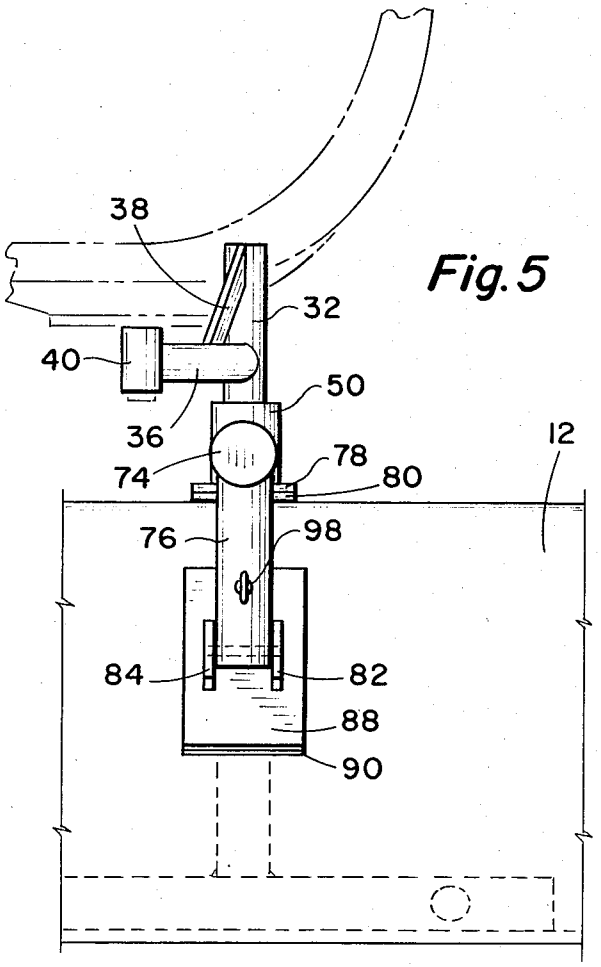
FIG. 5 is a view taken on line 5—5 of FIG. 2.
Figure 4:
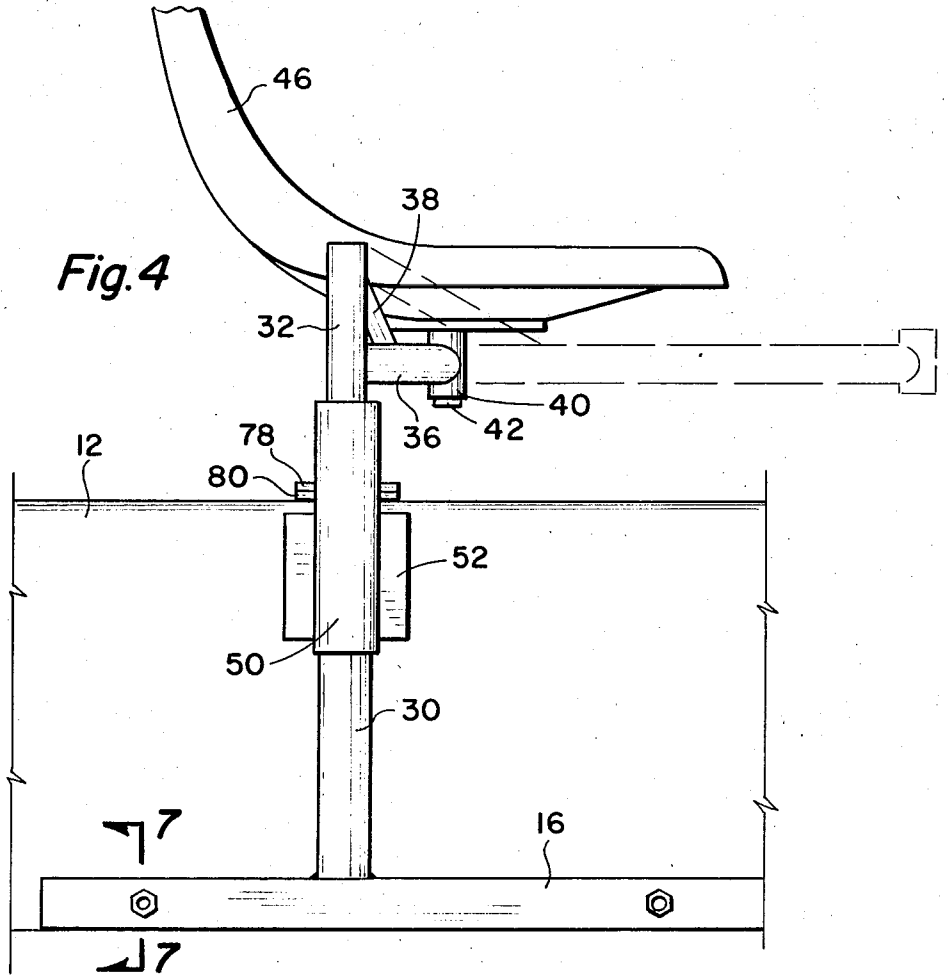
FIG. 4 is a view taken on line 4—4 of FIG. 2.
Figure 8:
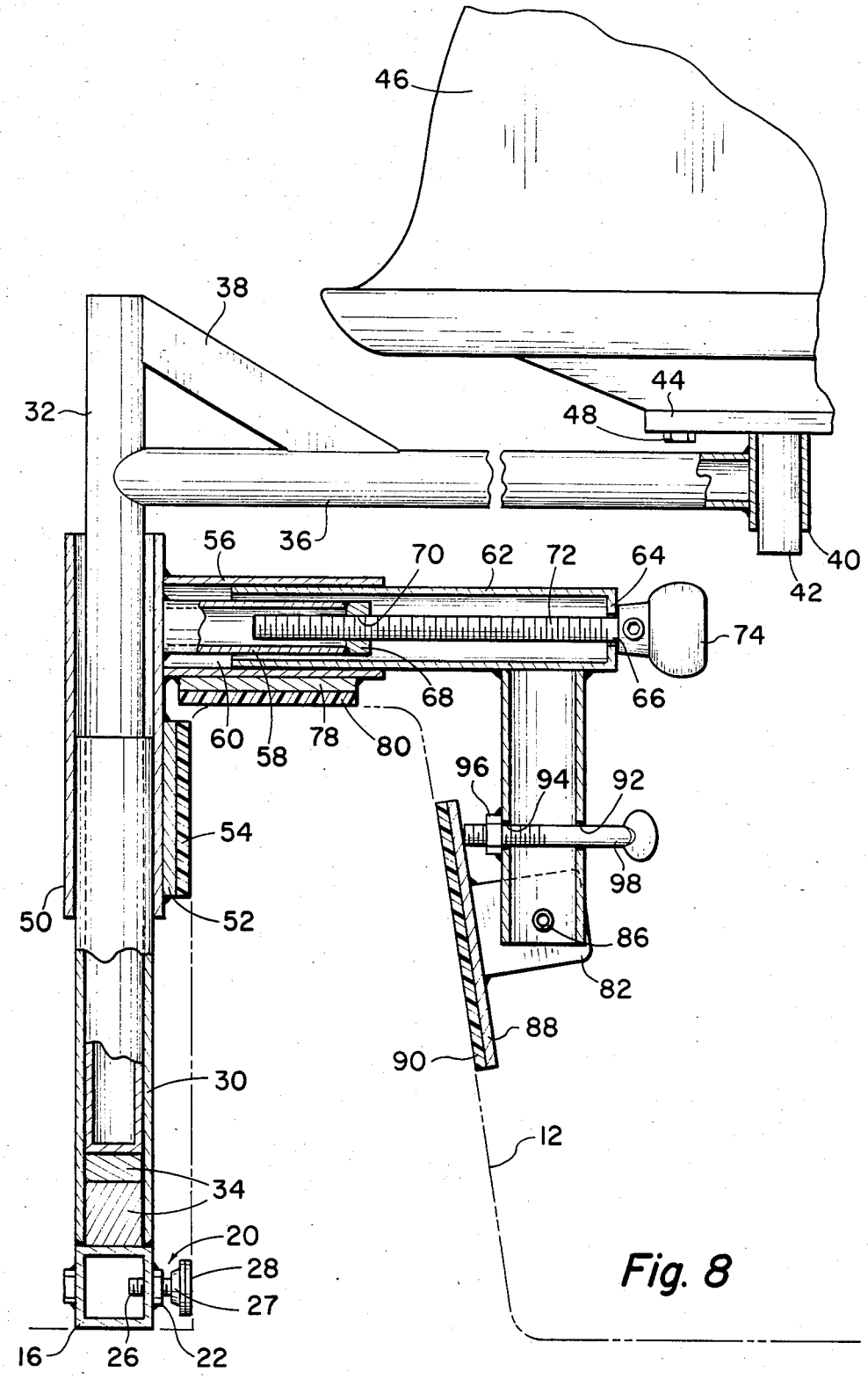
FIG. 8 is a view taken on line 8—8 of FIG. 3.

Referring to the drawings in detail, reference character 10 generally indicates a swing-in-swing-out seat apparatus adapted to be installed on the sidewall 12 of a suitable bathtub-showerstall appliance 14, or the like. The apparatus 10 comprises a first stabilizer or bar means 16 adapted to be positioned on the surface or floor 18 immediately adjacent to or in the proximity of the outer periphery of the sidewall 12 of the bathtub-shower stall unit 14. The bar means 16 is preferably constructed from a suitable hollow bar stock of substantially square cross sectional configuration, but not limited thereto and having the opposite ends thereof closed. Suitable adjustable spacer means 20 is provided on the bar means 16 in order to facilitate the installation of the apparatus 10 on the sidewall 12 as will be hereinafter set forth. As shown herein, the adjustable spacer means comprises a plurality of substantially identical spacer assemblies 20 disposed in longitudinally spaced relation along one side wall of the bar 16. As particularly shown in FIG. 5, each spacer assembly 20 includes a nut member 22 welded or otherwise secured to the outer periphery of the bar means 16 in substantial axial alignment with an aperture 24 provided in the sidewall of the bar 16. A threaded shank member 26 is secured to the nut 22 and extends through the aperture 24 in such a manner that one end thereof is disposed within the interior of the bar means 16 and the opposite end thereof is disposed exteriorly thereof. A suitable stop member 27 is secured to the outer or exposed end of the threaded shank 24, and is provided with a yieldable gasket 28, or the like, on the outer face thereof. The distance between the bar means 16 and the outer periphery of the side wall 12 may be adjusted as required by the manual rotation of the threaded shank means 24, as will be hereinafter set forth.

Figure 6:
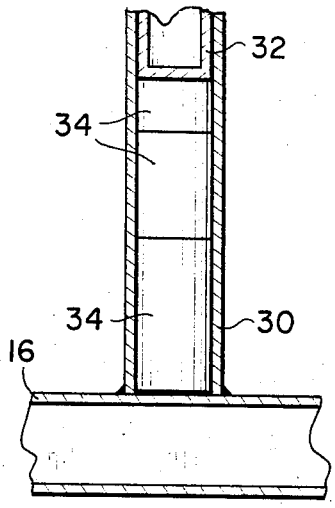
FIG. 6 is a view taken on line 6—6 of FIG. 2.

An upstanding post or pipe means 30 is welded or otherwise secured to the outer periphery of one side of the bar means 16 and extends upwardly therefrom. The upper end of the post 30 is open for slidably and rotatably receiving a rod or tube means 32 therein. The upper end of the tube 32 extends to a position above the upper limit of the sidewall 12, and the lower end thereof may be supported within the pipe or post 30 by suitable spacer members 34 (FIG. 6). A seat support arm means 36 is welded or otherwise rigidly secured to the outer periphery of the rod 32 in the proximity of the upper end thereof and extends radially outwardly therefrom. It is preferable to secure a brace member 38 between the arm 36 and tube 32 for strengthening thereof as is well known.

A sleeve member 40 is rigidly secured to the outer end of the support arm 36 in any suitable manner and is open for receiving a stub shaft means 42 therethrough. The shaft means 42 may be either rotatably secured to the sleeve 40 or may be rigidly secured thereto, as desired. A flange 44 is secured to the upper end of the shaft 42 and is secured to the underside of a suitable seat means 46 in any suitable manner, such as by a plurality of bolts 48. The chair or seat 46 is thus secured to the support arm means 36 and movable therewith as the rod 32 is rotated about its own longitudinal axis as will be hereinafter set forth.

Figure 7:
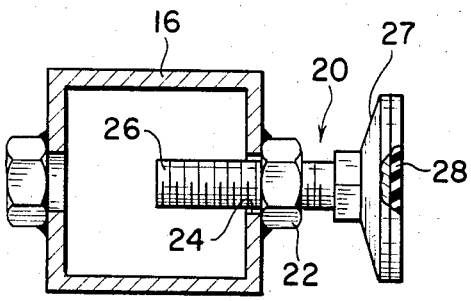
FIG. 7 is a view taken on line 7—7 of FIG. 4.

A collar member 50 is disposed around the outer periphery of the pipe 30 and extends longitudinally outwardly from the upper end thereof as particularly shown in FIG. 7. A bumper plate 52 is welded or otherwise secured to the outer periphery of the collar 50 in the proximity of the lower end thereof and is provided with a resilient or yieldable bumper pad 54 on the outer face thereof for engagement with the outer periphery of the sidewall 12. The collar 50 is preferably slidable and rotatable with respect to the pipe 30 for facilitating the initial installation of the apparatus 10 on the sidewall 12 of the bathtub-shower stall unit 14 as will be hereinafter set forth.

A sleeve member 56 may be welded or otherwise rigidly secured to the outer periphery thereof and is disposed in concentric spaced relation with respect to an inner sleeve member 58 to provide an annular space 60 therebetween. A sleeve 62 has one open end slidably disposed in the annulus 60 and the outer end closed by a wall 64 having a central aperture 66 therein. The outer end of the inner sleeve 58 is closed by a block member 68 having a threaded bore 70 therein. A threaded shank 72 extends through the bore 66, longitudinally through the sleeve 62 and into threaded engagement with the bore 70, and is provided with a stop means or head member 74 engagable with the outer end of the wall 64 whereby rotation of the shank 72 in one direction moves the sleeve member 62 in a direction toward the collar 50 and rotation of the shank in an opposite direction permits movement of the sleeve 62 in a direction away from the collar 50. A pipe or tube means 76 is welded or otherwise rigidly secured to the outer periphery of the sleeve 72 and extends radially outwardly therefrom for a purpose as will be hereinafter set forth. In addition, a suitable bumper plate 78 may be secured to the outer periphery of the sleeve 56 and is provided with a bumper pad 80 on the outer face thereof for engagement with the upper end of the sidewall 12 as will be hereinafter set forth.

A pair of plates 82 and 84 are disposed on the opposite sides of the pipe 76 in the proximity of the outer end thereof and may be pivotally secured thereto in any suitable manner, such as by a pivot pin means 86 extending through the pipe. A bumper plate 88 is welded or otherwise rigidly secured to the free ends of the plates 82 and 84 and a bumper pad 90 is secured to the outer face of the plate 88 for engagement with the inner periphery of the sidewall 12. A pair of aligned apertures 92 and 94 are provided in the wall of the pipe 76 and interposed between the pivot pin and the sleeve 62. A threaded nut 96 may be secured to the outer periphery of the pipe 76 in substantial axial alignment with the bore or aperture 94. An adjustment screw means 98 extends through the apertures 92 and 94 for threaded engagement with the nut 96 whereby the end of the screw means 98 may engage the inner face of the bumper plate 88 in spaced relation with respect to the pivot pin 86. It will be readily apparent that the position of the adjustment screw against the bumper 88 will determine the angular orientation of the plane of the plate 88 whereby the bumper pad 84 may be placed adjacent the inner periphery of the sidewall 12 regardless of the angular orientation of the sidewall.

Figure 1:
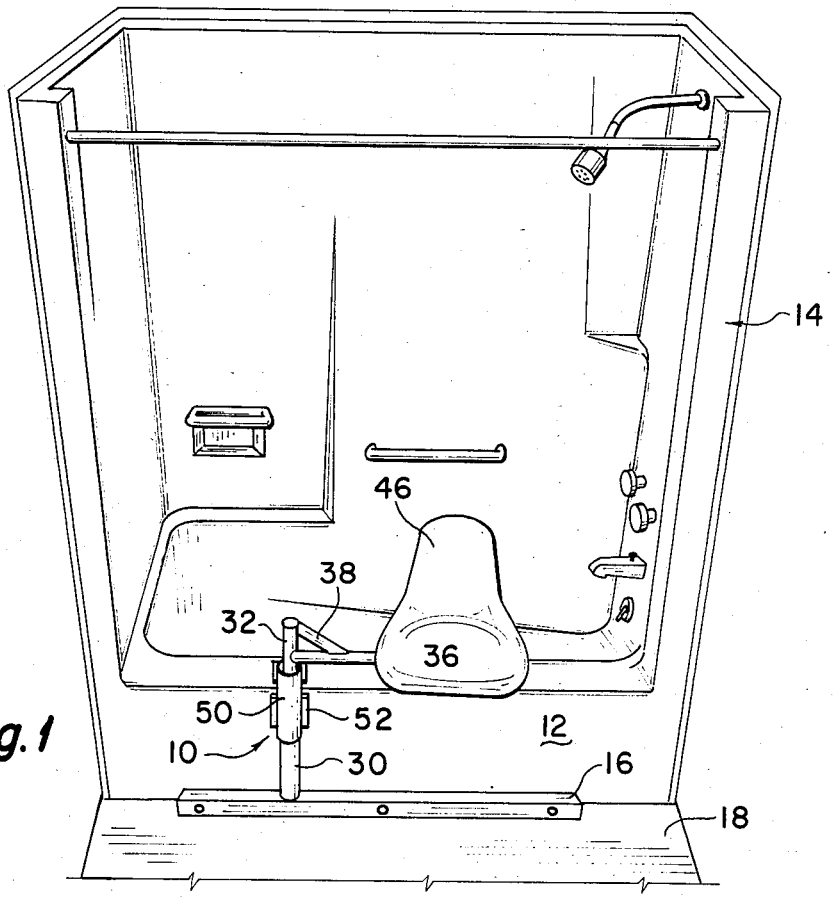
FIG. 1 is a perspective view of a bathtub-shower stall having a swing-in-swing-out seat apparatus embodying the invention installed thereon.
Figure 2:
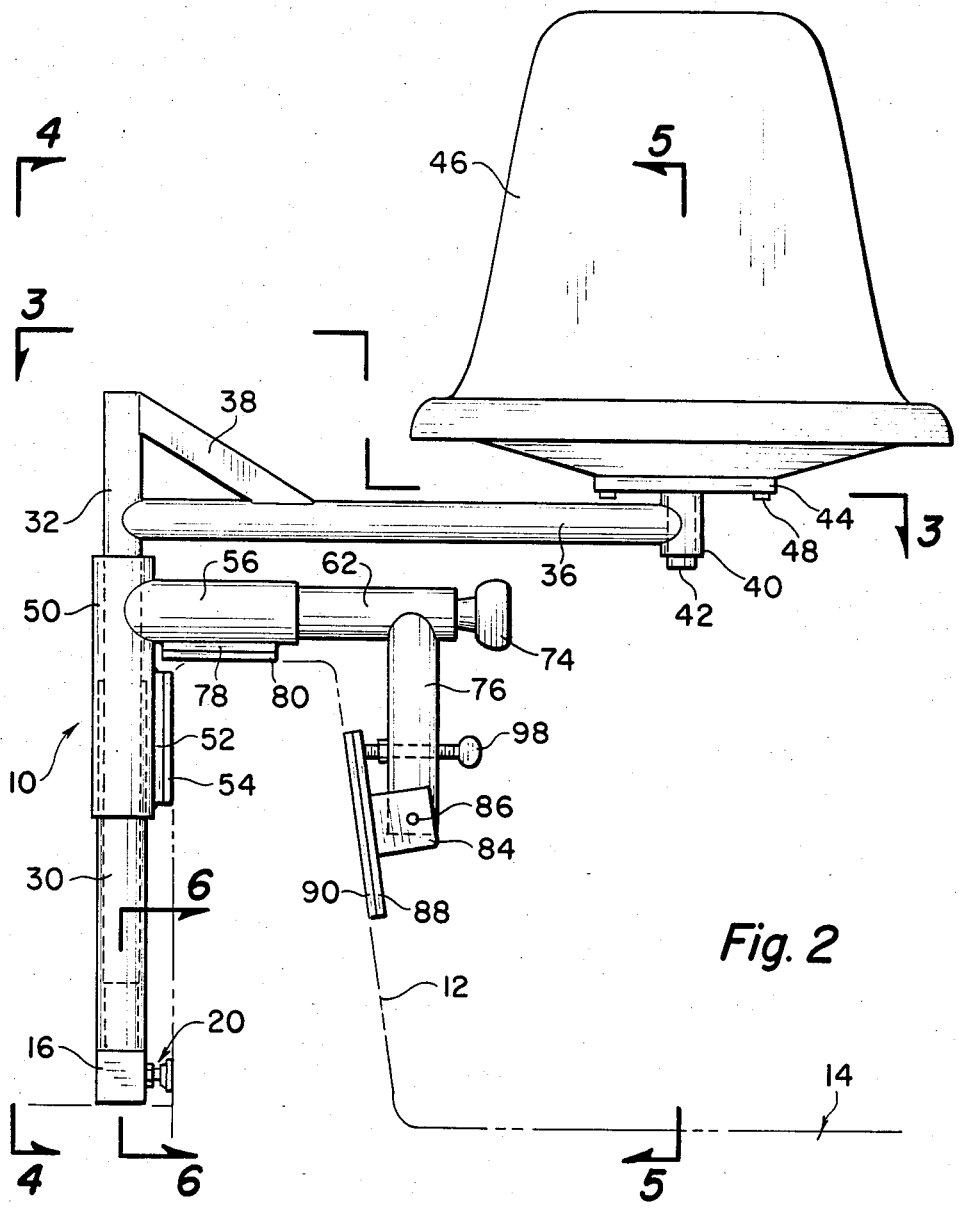
FIG. 2 is a front elevational view of a swing-in-swing-out seat apparatus embodying the invention, with the bathtub on which it is installed shown in broken lines.
Figure 3:
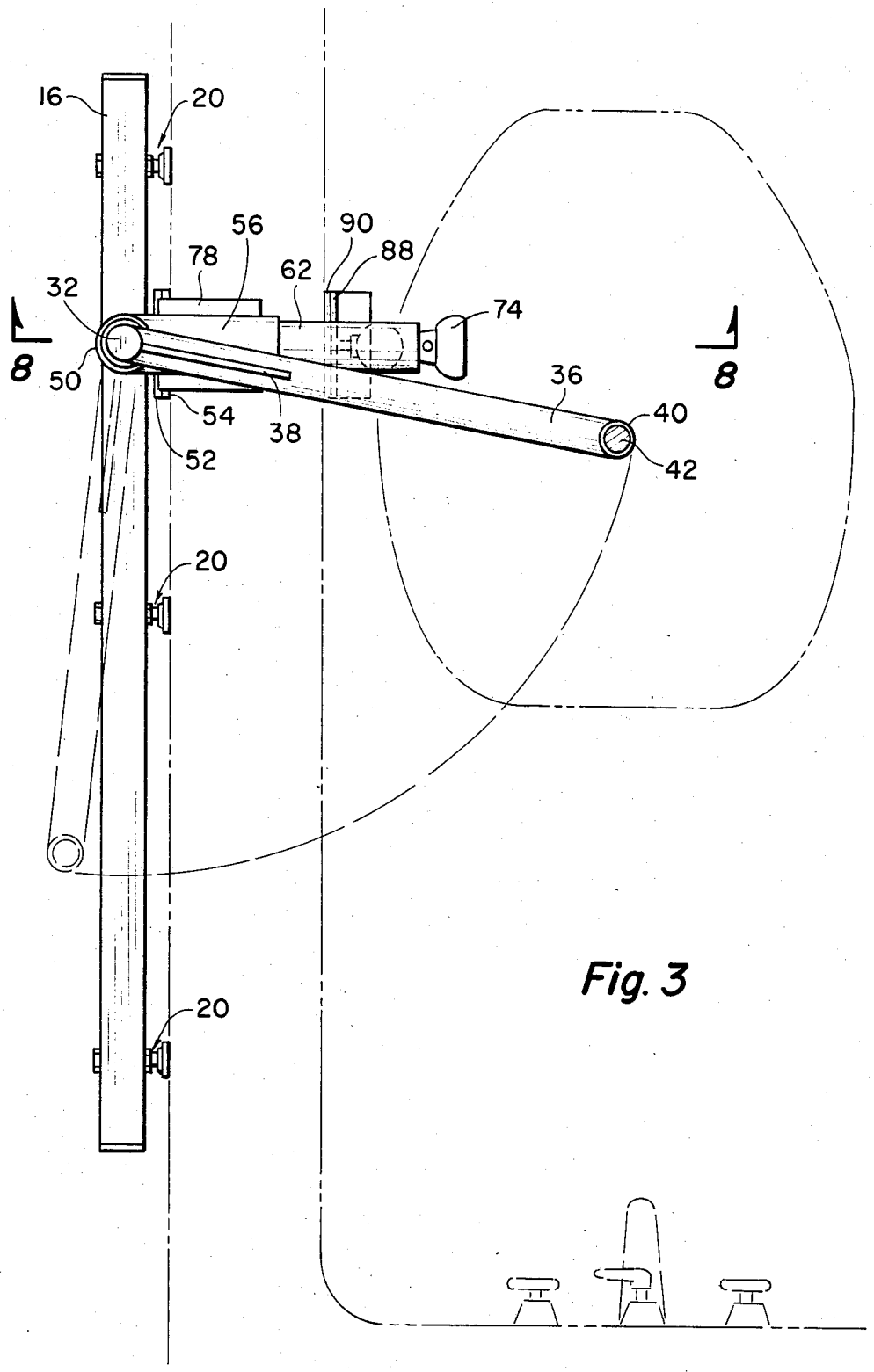
FIG. 3 is a view taken on line 3—3 of FIG. 2.

In use, the apparatus 10 may be installed on the sidewall 12 of substantially any bathtub-shower stall unit, or the like, as particularly shown in FIG. 1. The apparatus 10 may either be secured to the tub in a right-hand installation or a left-hand installation without alteration of the structure of either the tub assembly or the apparatus 10.

In order to install the apparatus 10, the horiziontal bar means 16 may be placed on the floor 18 in the proximity of the outer periphery of the sidewall 12. The collar may be arranged longitudinally on the pipe 30 in such a manner that the bumper pad 80 is brought into engagement with the upper end of the sidewall 12 and the bumper pad 54 is in engagement with the outer periphery of the sidewall. The adjustable spacer means 20 may then be manually adjusted for placing the stop members 27-28 in engagement with the outer periphery of the sidewall 12, thus assuring that the desired upright orientation for the post 30 and tube 32 will be attained and retained. The plates 82 and 84 may be pivoted about the pivot pin 86 in the required manner for placing the bumper pad 90 in engagement with the inner periphery of the sidewall 12, and the adjustment screw means 92 may be moved into engagement with the bumper plate 88 for securely retaining the plate and pad in engagement with the sidewall 12. Thus, the apparatus 10 is securely and efficiently secured to the sidewall 12. It will be apparent that the weight of the occupant of the seat is directed to the floor.

The arm 36 may be moved in the proper direction for rotating the tube 32 about its own longituidnal axis for swinging the seat or chair 46 into a position exteriorly of the bathtub-shower stall unit 14. The seat 46 may be pivoted about the axis of the shaft 42 in order to provide the desired orientation of the seat for accepting the person desiring to sit on the seat during a showering operation, as particularly shown in FIG. 1. When the person has positioned himself on the seat, the orientation of the seat itself and the rotation of the rod 32 in a direction for swinging the seat into a position within the bathtub-showerstall unit 14. Of course, in the event the seat is rigidly secured to the sleeve 40, it is preferable that the selected orientation of the seat be such as to provide the optimum position thereof for both receiving the occupant thereon and supporting the occupant in the shower stall during a showering operation. Of course, any suitable shower curtain may be utilized during a showering operation, it being preferable to provide a vertical slit in the curtain for receiving the arm 36 therein.

The installation procedure may be reversed in order to remove the apparatus 10 from the bathtub-shower stall unit 14.

From the foregoing it will be apparent that the present invention provides a novel swing-in-swing-out seat for a bathtub-showerstall unit whereby a somewhat indisposed person may be facilitated during the showering operation. The novel device includes a horizontally arranged bar disposed on the floor adjacent the bathtub, and having an upright post means pivotally supporting a seat means for movement between an outer and an inner orientation with respect to the shower stall. The assembly assures that the weight of the occupant of the seat will be transferred to the floor at all times, and the apparatus is efficiently secured to the sidewall of the bathtub in a manner providing for security of the user of the device.

Whereas the present invention has been described in particular relation to the drawings attached hereto, it should be understood that other and further modifications, apart from those shown or suggested herein may be made within the spirit and scope of this invention.

What is claimed is:

1. A swing-in swing-out chair apparatus for a bathtub-shower stall unit comprising:

bar means adapted to be disposed on the floor adjacent the side wall of the bathtub-shower stall unit;

an upstanding pipe means fixed to said bar means;

a collar slideably secured to said pipe means;

a tube means slideably and rotatably mounted in the top of said pipe means and extending therefrom upwardly to a position above the upper limit of the side wall;

support arm means secured to the tube means and extending radially outwardly therefrom and moveable with the tube means;

seat means secured to the arm means and movable therewith to positions externally of or internally of the bathtub-shower stall unit;

anchoring means carried by the collar for removably securing the apparatus to the side wall of the bathtub-shower stall unit.

2. A swing-in-swing-out chair apparatus as set forth in claim 1 and including adjustable spacer means provided on the bar for adjusting the position between the outer periphery of the sidewall and the inner periphery of the bar for facilitating stability of the installed apparatus.

3. A swing-in-swing-out chair apparatus as set forth in claim 1 and including pivotal means securing the set means to the arm means for free pivotal movement of the seat with respect to the arm means.

4. A swing-in swing-out chair apparatus as set forth in claim 1 wherein the anchoring means comprises telescopic arm means secured to the collar and extending radially outwardly therefrom, and bumper means engagable with the sidewall for securing the apparatus thereto.

5. A swing-in-swing-out chair apparatus as set forth in claim 4 wherein the bumper means comprises first bumper plate and pad means secured to the outer periphery of the collar for engagement with the outer periphery of the sidewall, and second bumper plate and pad means secured to the outer periphery of the telescopic arm means for engagement with the upper end of the sidewall.

6. Swing-in-swing-out chair apparatus as set forth in claim 5 wherein the bumper means includes third bumper plate and pad means pivotally secured to the telescopic arm means for engagement with the inner periphery of the sidewall.

7. Swing-in-swing-out chair apparatus as set forth in claim 6 wherein the third bumper plates and pad means comprises a sleeve member secured to the outer periphery of the telescopic arm means and extending radially outwardly therefrom in a direction toward the inner periphery of the sidewall, flange means pivotally secured to the sleeve member in spaced relation with respect to the telescopic arm means, a bumper plate and pad member secured to the free end of the flange means and engagable with the inner periphery of the sidewall.

8. Swing-in-swing-out chair apparatus as set forth in claim 7 and including adjustment means secured to the sleeve member and selectively engagable with the bumper plate and pad member for retaining thereof in secure engagement with the inner periphery of the sidewall.

9. A swing-in swing-out chair apparatus as set forth in claim 6 including a pivot supported by said telescopic arm means; means to limit the rotation of said third bumper plate and said pad means about said pivot on said telescopic arm means, and screw means supported by said telescopic arm means to engage the interface of the bumper plate.

* * * * *